US010795279B2

(12) United States Patent
Motoyama

(10) Patent No.: US 10,795,279 B2
(45) Date of Patent: Oct. 6, 2020

(54) IMAGE FORMING APPARATUS HAVING OPTICAL PRINT HEADS

(71) Applicant: CANON KABUSHIKI KAISHA, Tokyo (JP)

(72) Inventor: Hajime Motoyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/682,508

(22) Filed: Nov. 13, 2019

(65) Prior Publication Data

US 2020/0159144 A1 May 21, 2020

(30) Foreign Application Priority Data

Nov. 20, 2018 (JP) ..... 2018-217568

(51) Int. Cl.
*G03G 15/00* (2006.01)
*G03G 15/04* (2006.01)
*G03G 21/16* (2006.01)

(52) U.S. Cl.
CPC . *G03G 15/04036* (2013.01); *G03G 15/04054* (2013.01); *G03G 15/80* (2013.01); *G03G 21/1652* (2013.01); *G03G 2215/0409* (2013.01)

(58) Field of Classification Search
CPC ..... G03G 15/04036; G03G 15/80; G03G 21/1652; G03G 21/1666; G03G 2221/166; G03G 2221/1636; G03G 15/04054; G03G 15/04063; G03G 15/04072; G03G 2215/0409; G03G 2215/0412; G03G 2215/0414
See application file for complete search history.

(56) References Cited

U.S. PATENT DOCUMENTS

2009/0169228 A1* 7/2009 Yokoi ..... G03G 15/80 399/51
2011/0236073 A1* 9/2011 Komatsu ..... G03G 15/04054 399/177
2012/0207504 A1* 8/2012 Hamaya ..... G03G 15/80 399/88
2013/0077986 A1* 3/2013 Mori ..... G03G 21/1652 399/90
2015/0189778 A1* 7/2015 Fujiwara ..... G03G 15/605 399/405

FOREIGN PATENT DOCUMENTS

JP 2009-157138 A 7/2009

* cited by examiner

*Primary Examiner* — Walter L Lindsay, Jr.
*Assistant Examiner* — Laura Roth
(74) *Attorney, Agent, or Firm* — Canon U.S.A., Inc. I.P. Division

(57) ABSTRACT

A configuration in which print heads disposed on an upper cover and a control substrate disposed on a housing are electrically connected via cables. The cables connect the print heads and the control substrate while passing through the back side of the rotating shaft in the housing so that a part of the cables contacts the rotating shaft or a grounded metallic receiving member disposed near the rotating shaft for supporting a part of the cables.

13 Claims, 9 Drawing Sheets

IMAGE FORMING APPARATUS HAVING OPTICAL PRINT HEADS

BACKGROUND

Field of the Disclosure

The present disclosure generally relates to image forming apparatuses and more specifically relates to an image forming apparatus having a cover for opening and closing an opening formed on a housing, and optical print heads disposed on the cover.

Description of the Related Art

Image forming apparatuses, such as printers and copying machines, include optical print heads each of which includes a plurality of light emitting elements for exposing photosensitive drums to light. Examples of light emitting elements include Light Emitting Diodes (LEDs) and Organic Electro Luminescence (EL) elements. Some known optical print heads include these light emitting elements arranged in a row or in two rows in a zigzag pattern along the rotating axis of a photosensitive drum. The optical print head includes a plurality of lenses for condensing light emitted from the plurality of light emitting elements onto the photosensitive drum. The plurality of lenses is arranged so as to face the surface of the photosensitive drum along the arrangement direction of the light emitting elements, between the plurality of light emitting elements and the photosensitive drum. The light emitted from the plurality of light emitting elements condenses on the surface of the photosensitive drum via the lenses, and forms an electrostatic latent image on the photosensitive drum.

Some image forming apparatuses including optical print heads have the optical print heads disposed on an upper cover rotatable with respect to the main body housing. An opening is formed on the upper part of the main body housing, and the upper cover covers this opening. The upper cover rotates with a back portion of the main body housing as the rotational axis. In association with the rotation of the upper cover, an optical print head moves to an exposure position where a photosensitive drum is exposed and to a retracting position where the optical print head is retracted from the photosensitive drum to a further extent than at the exposure position. When the upper cover is opened to open the opening, the optical print head is disposed at the retracting position. When the upper cover is closed to close the opening, the optical print head is disposed at the exposure position.

In the above-described configuration in which the optical print heads are disposed on the upper cover, a control substrate for controlling the drive of light emitting elements based on data about an image to be formed is included in the main body housing, and the control substrate disposed in the main body housing is connected to the optical print heads on the upper cover via cables, such as flexible flat cables (FFCs).

An image forming apparatus discussed in Japanese Patent Application Laid-Open No. 2009-157138 is provided with an upper cover for opening and closing an opening on the main body housing, at an upper part of the main body housing. The upper cover is disposed to be rotatable centering on a rotating shaft on a part of the main body housing. The upper cover is provided with a plurality of optical print heads (LED units). The main body housing includes a main substrate (control substrate) for controlling the light emission timing of light emitting elements (LEDs). The plurality of optical print heads is indirectly controlled by the main substrate via a relay substrate (LED control substrate). In the image forming apparatus discussed in Japanese Patent Application Laid-Open No. 2009-157138, the relay substrate is disposed on the upper cover. Each of the plurality of optical print heads is electrically connected to the relay substrate via an FFC, and the relay substrate and the main substrate are electrically connected via an FFC. The FFC electrically connecting the relay substrate on the upper cover and the main substrate in the main body housing is routed and wired on the back side of the rotating shaft disposed on a back portion of the main body housing.

In a configuration in which the optical print heads on the upper cover are electrically connected to the control substrate in the main body housing via cables, the cables may be bent near the rotating shaft and rubbed against a part of the upper cover and a part of the main body housing each time the user opens or closes the upper cover. Accordingly, static electricity is charged on the cables, and noise may be superimposed onto signals to be transmitted from the control substrate to the optical print heads, possibly resulting in inferior image forming.

SUMMARY

An image forming apparatus according to an exemplary embodiment of the present disclosure includes a housing, a drum unit having a photosensitive drum, configured to be attachable to and detachable from the housing through an opening on the housing, a cover configured to rotate with respect to the housing with a grounded metallic shaft member as a rotational axis, and to be movable to a closed position where the opening is closed and to an open position where the opening is open, a print head disposed on the cover and having a light emitting element for emitting light to expose the photosensitive drum, a control substrate disposed on the housing, configured to generate a control signal for controlling driving of the light emitting element, and a cable connected to the print head and the control substrate, to transmit the control signal from the control substrate to the print head. The cable is connected to the print head and the control substrate by passing on one side of the shaft member, the one side being opposite to a side on which the print head is disposed, in such a manner that the cable contacts the shaft member when the cover is at the closed position.

Further features of the present disclosure will become apparent from the following description of exemplary embodiments with reference to the attached drawings.

DESCRIPTION OF THE EMBODIMENTS

An exemplary embodiment for embodying the present disclosure will be described below with reference to the accompanying drawings. However, elements described in the following descriptions are to be considered as illustrative, and the present disclosure is not limited to the exemplary embodiment in the following descriptions.

(Overall Configuration of Image Forming Apparatus)

Figure 1:
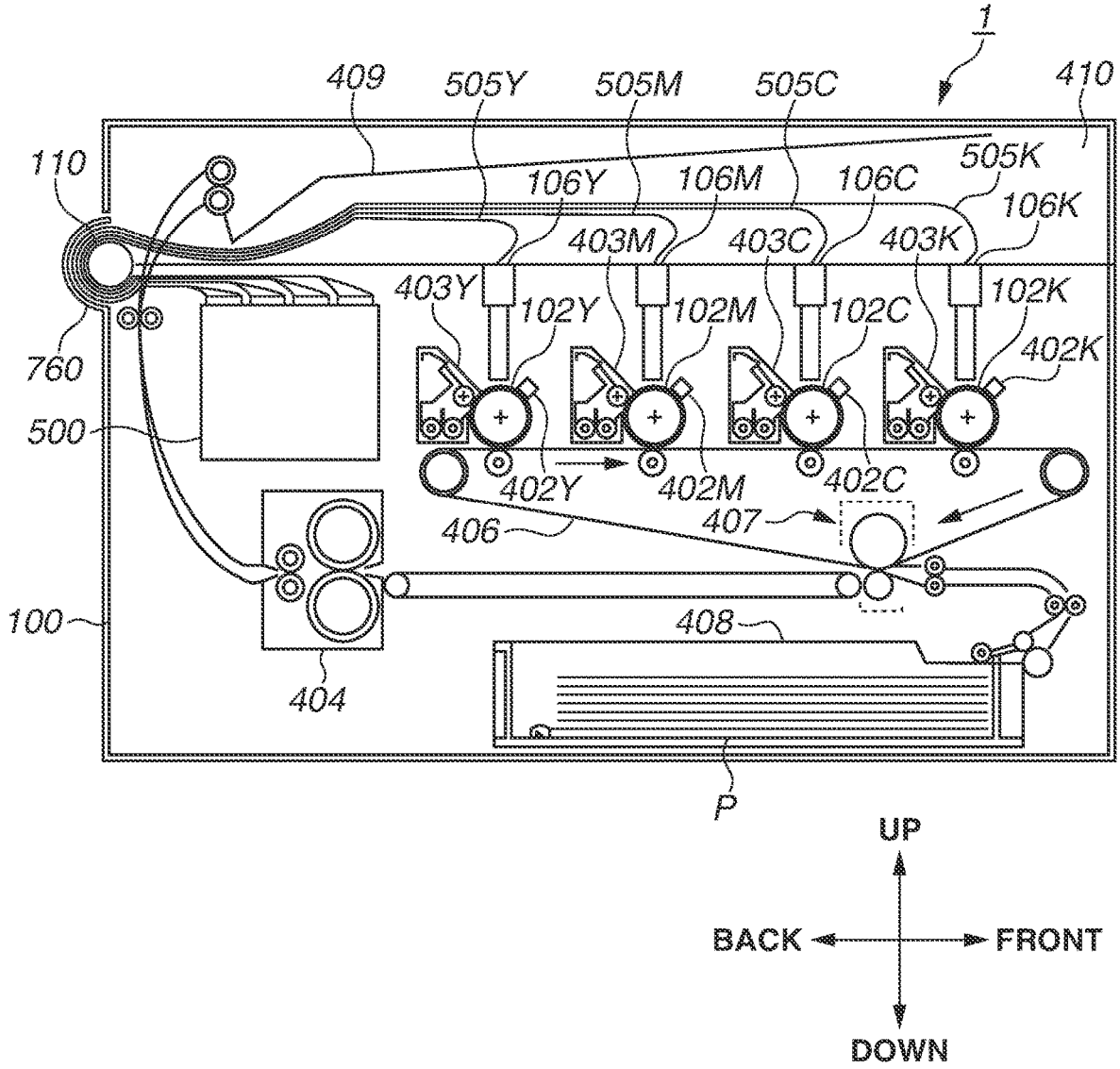
FIG. 1 is a cross-sectional view schematically illustrating an image forming apparatus with a cover closed.

A schematic configuration of an image forming apparatus 1 will be described initially. FIG. 1 is a cross-sectional view schematically illustrating the image forming apparatus 1. Although the image forming apparatus 1 illustrated in FIG. 1 is a single function printer (SFP) not having a reading apparatus, the present exemplary embodiment may be a multifunction peripheral having a reading apparatus. In addition, the present exemplary embodiment is not limited to a tandem-type color image forming apparatus having a plurality of photosensitive drums 102 as illustrated in FIG. 1. For example, the present exemplary embodiment may be a color image forming apparatus having one photosensitive drum 102 or an image forming apparatus for forming a monochrome image.

The image forming apparatus 1 illustrated in FIG. 1 includes photosensitive drums 102Y, 102M, 102C, and 102K (hereinafter collectively referred to as "photosensitive drum 102") corresponding to the colors yellow, magenta, cyan, and black, respectively. These photosensitive drums are separately disposed from each other.

In the following descriptions, as illustrated in FIG. 1, the side of the image forming apparatus 1 closer to the photosensitive drum 102K corresponding to black than the photosensitive drum 102Y corresponding to yellow is defined as the front side. More specifically, the front side of the image forming apparatus 1 means the side closer to the front face of the image forming apparatus 1. On the other hand, the side of the image forming apparatus 1 closer to the photosensitive drum 102Y corresponding to yellow than the photosensitive drum 102K corresponding to black is defined as the back side. Further, as illustrated in FIG. 1, an upper part illustrated on paper is defined as the vertically up side, and the lower side is defined as the vertically down side.

The image forming apparatus 1 includes charging units 402Y, 402M, 402C, and 402K (hereinafter also collectively and simply referred to as "charging units 402") for charging the photosensitive drums 102Y, 102M, 102C, and 102K, respectively. The image forming apparatus 1 also includes optical print heads 106Y, 106M, 106C, and 106K (hereinafter also collectively and simply referred to as "optical print heads 106") as exposure light sources for emitting light to which the photosensitive drums 102Y, 102M, 102C, and 102K are exposed, respectively. The image forming apparatus 1 illustrated in FIG. 1 is what is called an "upper surface exposure system" image forming apparatus in which the photosensitive drum 102 is exposed to light from up above in the vertical direction.

Examples of an exposure method employed in an electrophotographic image forming apparatus includes a laser beam scanning exposure method in which a beam emitted from a semiconductor laser is scanned with a rotating polygon mirror to expose a photosensitive drum to light via an f-O lens. The "optical print heads 106" according to the present exemplary embodiment are used for a light emitting diode (LED) exposure method for exposing the photosensitive drum 102 to light by using light emitting elements, such as LEDs arranged along the rotating axis of the photosensitive drums 102. The optical print heads 106 are not used for the above-described laser beam scanning exposure method.

The image forming apparatus 1 further includes development units 403Y, 403M, 403C, and 403K (hereinafter also collectively and simply referred to as "development unit 403") for developing electrostatic latent images on the photosensitive drums 102 with toner and develop toner images of the respective colors on the photosensitive drums 102. A subscript (Y, M, C, or K) following each reference numeral indicates the color of toner.

The image forming apparatus 1 includes an intermediate transfer belt 406 to which toner images formed on the photosensitive drums 102 are transferred. The toner images formed on the photosensitive drums 102 are sequentially transferred to the intermediate transfer belt 406. The image forming apparatus 1 includes a secondary transfer roller 407 for secondarily transferring a toner image on the intermediate transfer belt 406 to a recording sheet P conveyed from a sheet feeding unit 408, and a fixing unit 404 for fixing the secondarily transferred image to the recording sheet P.

An image forming process will be briefly described below with an example of a process of transferring a yellow toner image to the intermediate transfer belt 406. The optical print head 106Y exposes to light the surface of the photosensitive drum 102Y charged by the charging unit 402Y. Thus, an electrostatic latent image is formed on the photosensitive drum 102Y. Then, the development unit 403Y develops the electrostatic latent image formed on the photosensitive drum 102Y, with yellow toner. The yellow toner image developed on the surface of the photosensitive drum 102Y is then transferred to the intermediate transfer belt 406. Magenta, cyan, and black toner images are also transferred to the intermediate transfer belt 406 in a similar image forming process.

The toner images of the respective colors transferred to the intermediate transfer belt 406 are then transferred by a transfer bias of the secondary transfer roller 407 to the recording sheet P conveyed from the sheet feeding unit 408.

The fixing unit 404 fixes the toner image to the recording sheet P with heat and pressure. The recording sheet P having undergone the fixing processing by the fixing unit 404 is discharged to a discharge unit 409.

The image forming apparatus 1 includes a main body housing 100 and a cover 410. The cover 410 partially has a metallic frame to improve the strength thereof. The cover 410 may be configured by one metallic plate to improve the strength. The cover 410 is disposed on the upper part of the main body housing 100 and rotates with respect to the main body housing 100.

Figure 2:
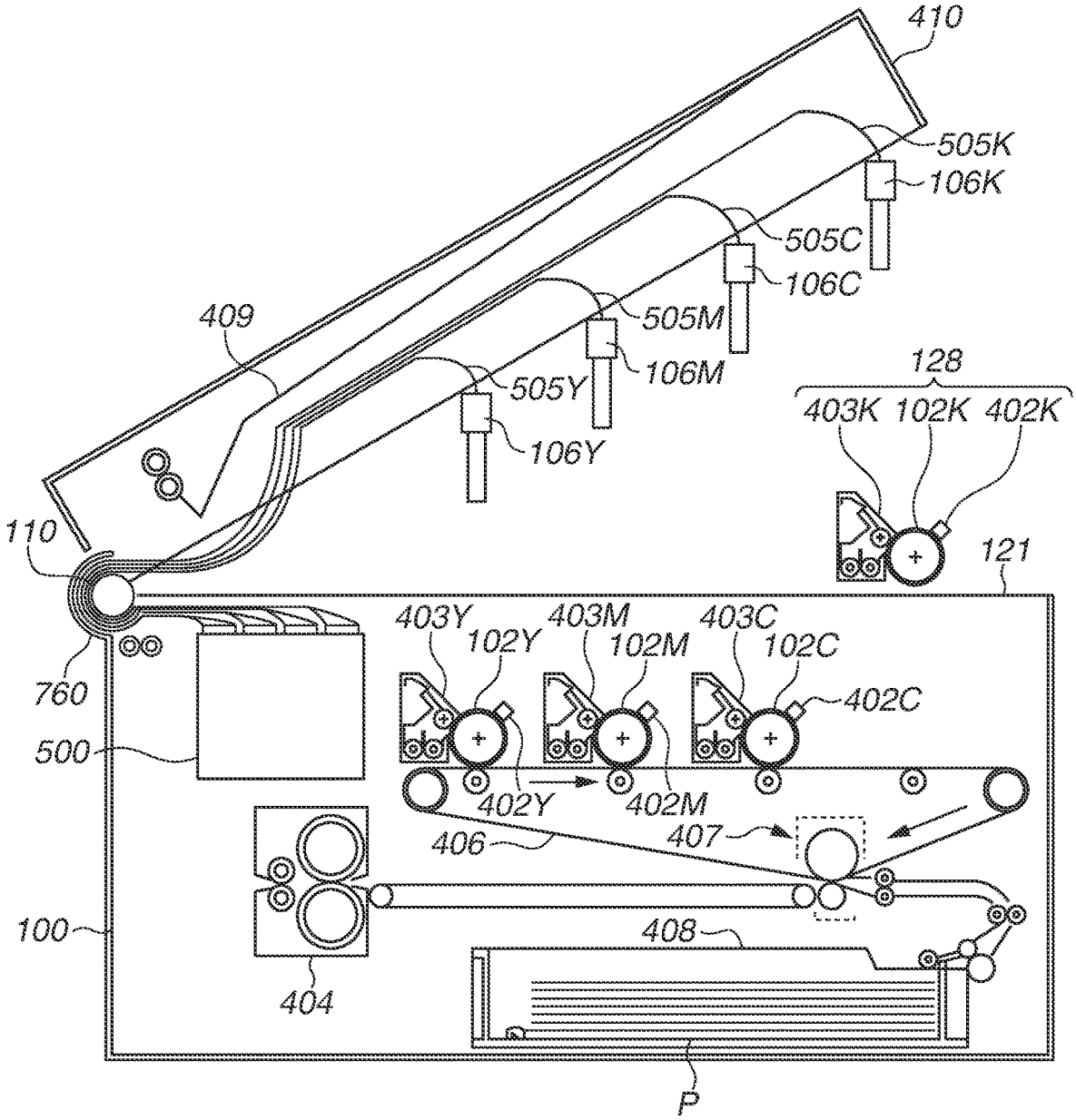
FIG. 2 is a cross-sectional view schematically illustrating the image forming apparatus with the cover opened.

FIG. 2 illustrates the image forming apparatus 1 with the cover 410 opened. As illustrated in FIG. 2, an opening 121 is formed on the vertically up side of the main body housing 100. The cover 410 rotates around a rotating shaft 110 on the main body housing 100 and is movable to a position where the opening 121 is closed and to a position where the opening 121 is open. As illustrated in FIG. 2, a drum unit 128 is attached to or detached from the main body housing 100 with the cover 410 opened. The drum unit 128 is attached to or detached from the main body housing 100 through the opening 121. More specifically, both when the drum unit 128 is detached from the main body housing 100 by the operator and when the drum unit 128 is attached to the main body housing 100 by the operator, the drum unit 128 passes through the opening 121. A passage path when the drum unit 128 passes through the opening 121 is on the front side of the rotating shaft 110. With the cover 410 closed, the cover 410 obstructs the passage path of the drum unit 128 in the opening 121. On the other hand, with the cover 410 opened, the passage path of the drum unit 128 in the opening 121 is open. With the cover 410 closed, the opening 121 is not necessarily be completely closed while the above-described passage path of the drum unit 128 in the opening 121 is to be obstructed.

The drum unit 128 is a replaceable cartridge which integrates a photosensitive drum 102, a charging unit 402, and a development unit 403. The drum unit 128 is periodically replaced by the operator, such as a user and a service personnel. Thus, the above-described "drum unit 128" is to have at least the photosensitive drum 102. The photosensitive drum 102 is rotatably supported with respect to the frame of the drum unit 128.

Further, only the photosensitive drum 102 may be configured to be attachable to and detachable from the drum unit 128. This configuration enables the operator to detach the drum unit 128 from the main body housing 100, detach the photosensitive drum 102 from the drum unit 128, and then replace the photosensitive drum 102 with a new photosensitive drum 102. Thus, the operator can replace only the photosensitive drum 102 without replacing the development unit 403 and the charging unit 402.

The cover 410 illustrated in FIGS. 1 and 2 rotates around the rotating shaft 110 which extends in the rotating axis of the photosensitive drum 102, as the rotational center. In other words, the direction of the rotational axis of the cover 410 coincides with the rotating axis direction of the photosensitive drum 102. More specifically, the optical print heads 106Y to 106K are arranged in a direction perpendicular to the rotation center axis direction of the cover 410. However, the rotational direction of the cover 410 is not limited to the direction illustrated in FIG. 1, and the rotating shaft 110 may extend in a direction orthogonal to the rotating axis of the photosensitive drum 102. Thus, the cover 410 is movable to an open position where the opening 121 is open and to a closed position where the opening 121 is closed, around the rotating shaft 110.

The rotating shaft 110 is arranged on the main body housing 100, and is a rod-like member which extends from one end side to the other end side of the main body housing 100 in the rotating axis of the photosensitive drum 102. In other words, the rotating shaft 110 extends from right to left of the main body housing 100 on a back portion of the main body housing 100. According to the present exemplary embodiment, the rotating shaft 110 is a metallic support with which grounding is ensured. The rigidity of the main body housing 100 can be improved by using a rotating shaft 110 made of metal. However, the rotating shaft 110 is not necessarily made of metal and may be a resin member.

The rotating shaft 110 is not necessarily a rod-like member extending from right to left of the main body housing 100 as in the present exemplary embodiment. The rotating shaft 110 may be provided at two positions on the right- and left-hand sides of the main body housing 100. In this case, the right- and left-hand sides of the cover 410 are rotatably attached to the two rotating shafts 110 on the right- and left-hand sides of the main body housing 100. The rotation center axes of the two rotating shafts 110 coincide with each other. Naturally, the number of positions where the rotating shafts 110 are disposed is not limited to two, and the rotating shafts 110 may be disposed at three or more positions.

The rotating shaft 110 is disposed on a back portion of the main body housing 100. More specifically, the rotating shaft 110 is disposed on the back side of the optical print heads 106, disposed on the cover 410, in the main body housing 100. With the cover 410 positioned at the closed position, the optical print heads 106 and the rotating shaft 110 are sequentially arranged from the front side of the main body housing 100 in the horizontal plane passing through the rotating shaft 110.

(Configuration of Optical Print Head)

Figure 3A:
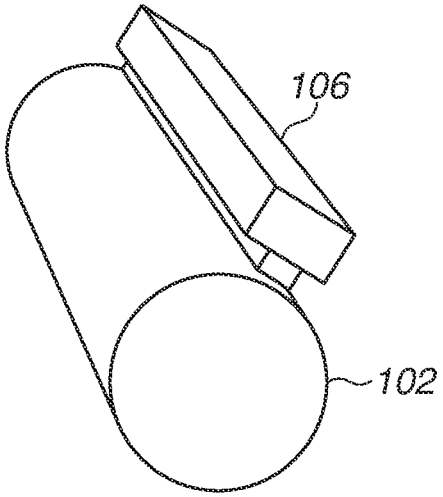
FIGS. 3A and 3B are schematic views illustrating an optical print head and a photosensitive drum.

FIG. 3A illustrates an arrangement of an optical print head 106 with respect to a photosensitive drum 102 when the cover 410 is closed. As illustrated in FIG. 3A, when the cover 410 is closed, the optical print head 106 faces the photosensitive drum 102, and the photosensitive drum 102 is exposed to light from the vertically up side of the photosensitive drum 102.

Figure 3B:
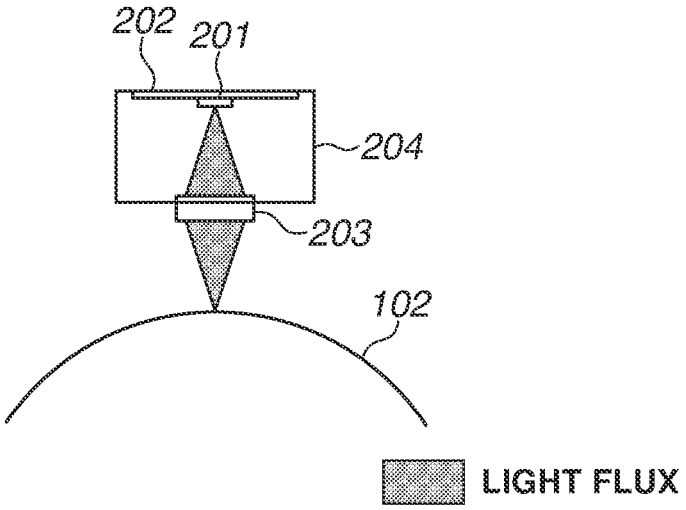

FIG. 3B illustrates a path of light emitted from the optical print head 106. The optical print head 106 includes a housing 204, a substrate 202, and a rod lens array 203. The housing 204 holds the substrate 202 and the rod lens array 203. According to the present exemplary embodiment, the housing 204 is an injection-molded member made of resin. However, the housing 204 may be a metallic frame with a resin-molded material partially attached thereto. A plurality of light emitting diode (LED) chips 201 is mounted on the substrate 202 (described below). Each of the LED chips 201 includes a plurality of LEDs as light emitting elements 126. The light emitted from the light emitting elements 126 is condensed on the surface of the photosensitive drum 102 via the rod lens array 203.

Figure 4A:
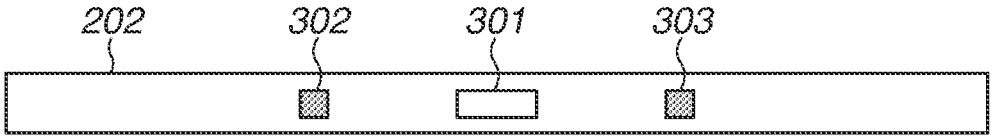
FIGS. 4A, 4B, and 4C illustrate a substrate and LED chips of an optical print head.
Figure 4B:
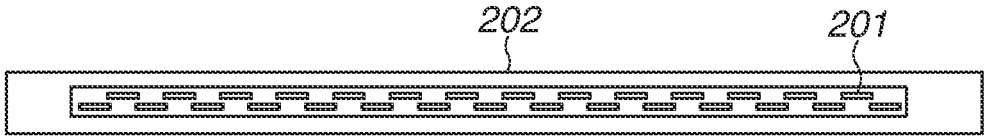
Figure 4C:
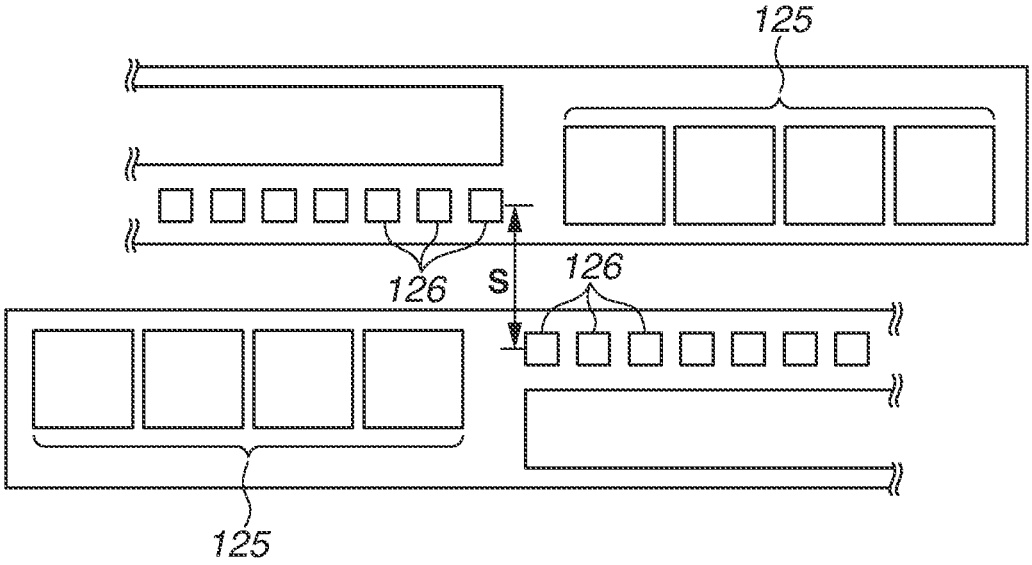

A configuration of a substrate 202 will be described in detail below. FIGS. 4A to 4C are enlarged views illustrating the substrate 202. FIG. 4A illustrates the surface where the LED chips 201 are mounted (hereinafter referred to as a mount surface). FIG. 4B illustrates the surface on the side opposite to the surface where LED chips 201 are mounted (hereinafter referred to as a non-mount surface). As illustrated in FIG. 4A, 29 LED chips 201 are arranged in a zigzag pattern. Each of the LED chips 201 includes 512 light emitting elements (LEDs) 126 arranged with predetermined resolution pitches in the longitudinal direction of the LED chip. According to the present exemplary embodiment, the resolution of the image forming apparatus 1 is 1200 dots per inch (dpi). Thus, the light emitting elements 126 are arranged in a row so that the distance between the centers of adjacent light emitting elements 126 in the longitudinal direction of the LED chip 201 is 21.16 μm. In an LED chip 201, the distance from one end to the other end of the arrangement of the light emitting elements 126 is about 10.8 mm Since the 29 LED chips 201 are arranged, 14,848 light emitting elements 126 are capable of emitting light for exposure. This enables image forming applicable to an image width of about 314 mm.

FIG. 4C illustrates a state of the boundary between adjacent LED chips 201. A wire bonding pad 125 for inputting control signals is disposed at an end of each LED chip 201. Signals (control signals) for controlling the light emission timing of the light emitting elements 126 to drive the light emitting elements 126 are input from the wire bonding pad 125 to the LED chip 201. The pitch of the light emitting elements 126 in the longitudinal direction is 21.16 μm also at the boundary between the LED chips 201. In addition, the distance between the light emitting points of the LED chips 201 in two rows (S illustrated in FIG. 4C) is about 84 μm (corresponding to 4 pixels in 1200 dpi or 8 pixels in 2400 dpi). In the non-mount surface of the substrate 202, a drive voltage control element 302 for controlling the voltage for driving the LED chips 201, a connector 301, and a storage element 303 are disposed. The storage element 303 temporarily stores information about the signals for driving the LED chips 201.

The connector 301 is connected with signal lines for controlling the drive voltage control element 302 and the storage element 303 from a main unit substrate 500, a power source, and a ground line. A wiring which extends from the drive voltage control element 302 and is used for driving the LED chips 201 passes through the inner layers of the substrates 202, and then is connected to each LED chip 201.

(Control Blocks)

Figure 5:
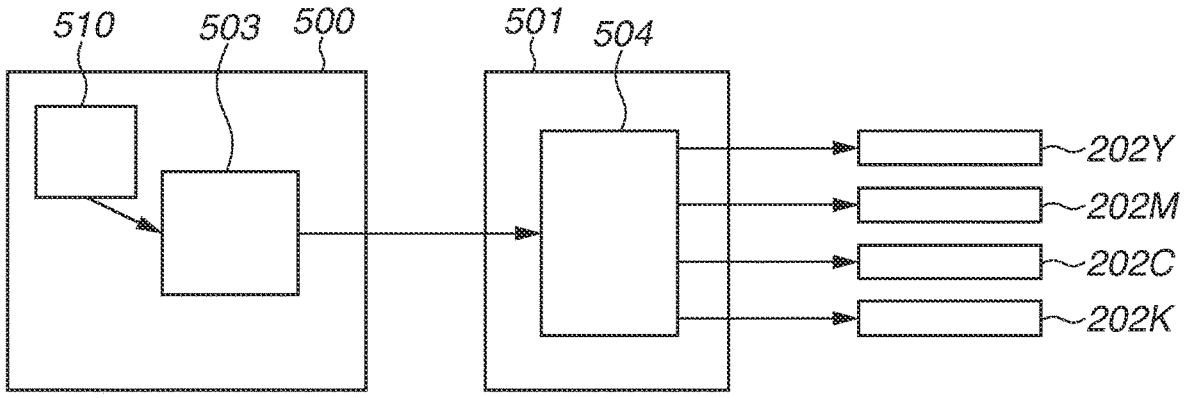
FIG. 5 illustrates a control block.

A control block diagram is illustrated in FIG. 5. A substrate configuration for controlling the optical print heads 106 according to the present disclosure includes the main unit substrate 500 (an example of a second substrate), a relay substrate 501 (an example of a first substrate), and the substrate 202 on which the LED chips 201 are mounted.

The main unit substrate 500 controls each unit of the main unit at the time of image forming. The main unit substrate 500 includes a main central processing unit (CPU) 510 for controlling each unit of the apparatus main unit. For example, the main unit substrate 500 generates control signals for controlling the drive of each light emitting element 126. In addition, the main unit substrate 500 controls the rotational speeds of the photosensitive drum 102 and a drive roller for driving a conveyance belt for conveying the paper P, and the conveyance speed of the paper P in the fixing unit 404. The main unit substrate 500 performs this control directly or indirectly via another control substrate (for example, the relay substrate 501). More specifically, referring to FIG. 5, the relay substrate 501 is not necessarily essential, i.e., each of substrates 202Y to 202K in the respective optical print heads 106 may be electrically connected to the main unit substrate 500 with cables (described below) and controlled without the relay substrate 501.

The main unit substrate 500 also includes an image control unit 503 for performing image processing. Upon reception of an image forming instruction from the main CPU 510, the main unit substrate 500 outputs image data about an image to be formed to a LED light emission control unit 504. This image data includes a plurality of pieces of unit image data to support the plurality of light emitting elements 126 included in the LED chips 201. The image control unit 503 outputs image data to the LED light emission control unit 504 in a predetermined order. The LED light emission control unit 504 generates irradiation data by using the image data output from the image control unit 503. The image data output from the image control unit 503 includes color information indicating colors. Based on the color information, the LED light emission control unit 504 transmits the irradiation data corresponding to respective colors to the substrates 202Y, 202M, 202C, and 202K corresponding to respective colors. Based on the irradiation data transmitted to the substrates 202, the LED light emission control unit 504 turns the light emitting elements 126 ON to irradiate the photosensitive drums 102 with light. As described above, the main unit substrate 500 controls each unit of the image forming apparatus 1 at the time of image forming based on a known technique.

(Wiring of Flexible Flat Cables)

A wiring path of cables 505Y to 505K (hereinafter also simply referred to as "cables 505") will be described below with reference to FIGS. 1 and 2. Although FIGS. 1 and 2 illustrate a configuration not including the relay substrate 501 illustrated in the block diagram in FIG. 5, the main unit substrate 500 and the optical print heads 106Y to 106K may be connected via the relay substrate 501 (this configuration will be described in detail below with reference to FIG. 7).

The substrates 202Y to 202K included in the optical print heads 106Y to 106K, respectively, are electrically connected with the main unit substrate 500 with the cables 505Y to 505K, respectively. The cable 505Y electrically connects the substrate 202Y and the main unit substrate 500 and transmits the control signals generated by the main unit substrate 500 to the substrate 202Y. The cable 505M electrically connects the substrate 202M and the main unit substrate 500 and transmits the control signals generated by the main unit substrate 500 to the substrate 202M. The cable 505C electrically connects the substrate 202C and the main unit substrate 500 and transmits the control signals generated by the main unit substrate 500 to the substrate 202C. The cable 505K electrically connects the substrate 202K and the main unit substrate 500 and transmits the control signals generated by the main unit substrate 500 to the substrate 202K. According to the present exemplary embodiment, the cables 505Y to 505K are each a flexible flat cable (FFC) into which a plurality of resin lead wires coated by resin is bundled.

As illustrated in FIGS. 1 and 2, the cables 505 pass through the back side of the rotating shaft 110 in the main body housing 100 when the main body housing 100 is viewed from the front side, and connect the substrates 202 and the main unit substrate 500. In other words, the cables 505 are wired on the side opposite to the side of the passage path of the drum units 128 in the opening 121 across the rotating shaft 110, i.e., the side opposite to the side where the optical print heads 106Y to 106K are disposed across the rotating shaft 110. The cables 505 extend, from the optical print heads 106 disposed on the front side of the rotating shaft 110 in the image forming apparatus 1, to the back side of the rotating shaft 110 in the image forming apparatus 1. The cables 505 are then folded back on the further back side of the rotating shaft 110 to be connected to the main unit substrate 500. According to the present exemplary embodiment, the main unit substrate 500 is disposed on the front side of the rotating shaft 110 in the image forming apparatus 1. Therefore, the cables 505 extending from the optical print heads 106 to the rotating shaft 110 are wired so as to wind around the rotating shaft 110, and extend up to the main unit substrate 500. With the cover 410 positioned at the closed position, the optical print heads 106, the rotating shaft 110, and the cables 505 are arranged in this order from the front side of the image forming apparatus 1 in a horizontal plane passing through the rotating shaft 110. In addition, a receiving member 760 for receiving the cables 505 is disposed further behind, more specifically, on the back side of the cables 505 disposed on the back side of the rotating shaft 110. The receiving member 760 is formed on the main body housing 100 to provide an effect of supporting the cables 505 which fall in the gravity direction by their own weight. The receiving member 760 is disposed on the side opposite to the side of the rotating shaft 110 with respect to the cables 505. Thus, the cables 505 are routed between the receiving member 760 and the rotating shaft 110. This prevents the wiring of the cables 505 from being disarranged even when the cover 410 is rotated with respect to the main body housing 100.

Since the receiving member 760 and the rotating shaft 110 are disposed in such a manner so as to pinch the cables 505, the cables 505 unfailingly contact the rotating shaft 110 which is grounded. With the rotation of the cover 410, the cables 505 may be rubbed against a part of the frame of the cover 410 or a part of the frame of the main body housing 100, and static electricity may be charged on the surface of the cables 505. With static electricity charged on the surface of the cables 505, when the control signals are transmitted from the main unit substrate 500 to the substrates 202 via the cables 505, generated control signals may be defective under the influence of static electricity. As described above, static electricity can be prevented from being charged on the surface of the cables 505 because the cables 505 are in contact with the grounded metallic rotating shaft 110. A configuration in which the rotating shaft 110 is not grounded and the receiving member 760 is grounded is also applicable. In such a case, since the receiving member 760 is made of a metal, static electricity charged on the surface of the cables 505 is discharged via the receiving member 760. Naturally, a configuration in which both the rotating shaft 110 and the receiving member 760 are made of a metal and are grounded is also applicable.

Figure 6A:
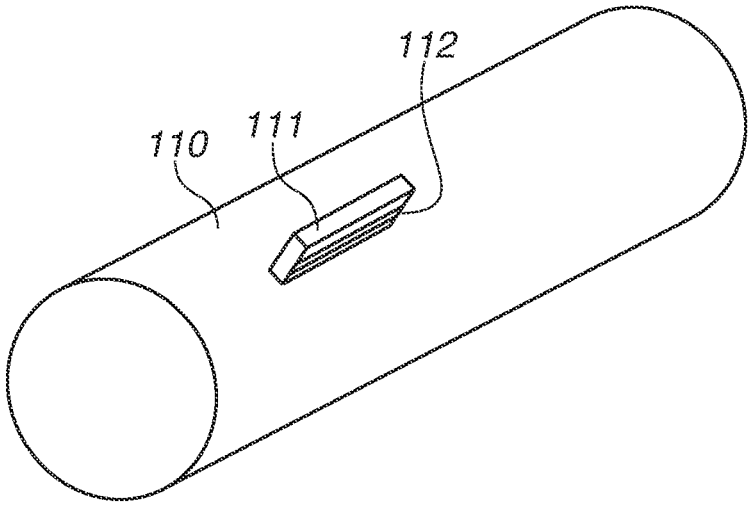
FIGS. 6A and 6B illustrate a structure for bringing a cable into contact with a rotating shaft or receiving member.

An example of a structure for unfailingly bringing the cables 505 into contact with the rotating shaft 110 or the receiving member 760 will be described below. FIG. 6A is a schematic perspective view illustrating the rotating shaft 110 included in the image forming apparatus 1, and FIG. 6B is a schematic perspective view illustrating the receiving member 760 included in the image forming apparatus 1.

As illustrated in FIG. 6A, the rotating shaft 110 may be provided with a stopping portion 111. The stopping portion 111 with an opening 112 formed therein as a passage of the cables 505 is integrally formed with the rotating shaft 110. The cables 505 are wired around the rotating shaft 110 so as to pass through the opening 112. Since both the rotating shaft 110 and the stopping portion 111 are integrally formed metallic members which are grounded, the surface of the cables 505 is also grounded. The rotating shaft 110 and the stopping portion 111 may be formed as separate members as long as they are electrically conductive with each other. For example, a notch may be formed on the stopping portion 111 and overlap with the opening 112. More specifically, the opening 112 is not necessarily be a hole penetrating the stopping portion 111 as long as the opening 112 has the function of substantially holding a part of the cables 505.

Figure 6B:
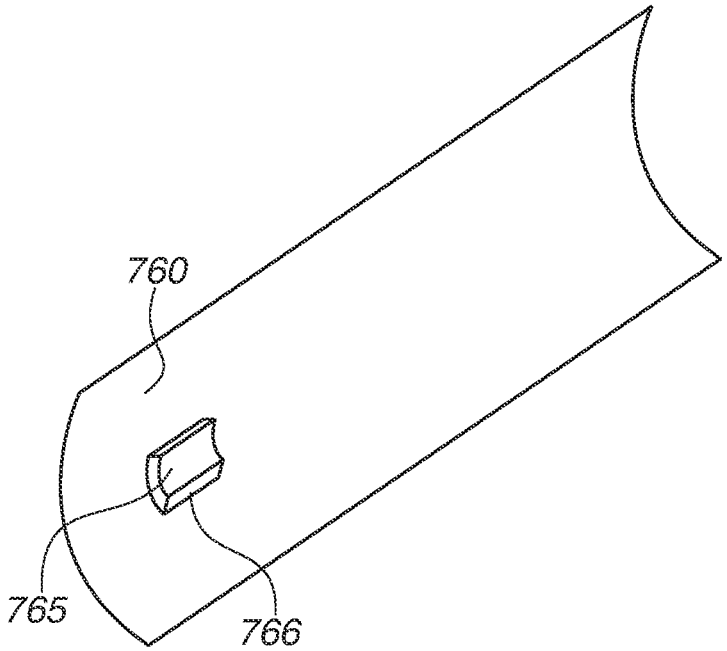

As illustrated in FIG. 6B, the receiving member 760 may be provided with a stopping portion 765. The stopping portion 765 with an opening 766 formed therein as a passage of the cables 505 is integrally formed with the receiving member 760. The cables 505 are wired around the rotating shaft 110 so as to pass through the opening 766. Since both the receiving member 760 and the stopping portion 765 are integrally formed metallic members which are grounded, the surface of the cables 505 is also grounded. The receiving member 760 and the stopping portion 765 may be formed as separate members as long as they are electrically conductive with each other. For example, a notch may be formed on the stopping portion 765 and overlap with the opening 766. More specifically, the opening 112 is not necessarily be a hole penetrating the stopping portion 765 as long as the opening 112 has the function of substantially holding a part of the cables 505.

As previously mentioned, the cables 505 contact both the rotating shaft 110 and the receiving member 760 by their own weight. Thus, the stopping portion 111 and the stopping portion 765 are not necessarily be essential members. More specifically, the stopping portion 111 and the stopping portion 765 can be omitted as long as the cables 505 unfailingly contact the rotating shaft 110 and the receiving member 760.

In addition, instead of forming the stopping portion 111 and the stopping portion 765, a part of the cables 505 may be bonded to the rotating shaft 110 with an aluminum tape or adhesive. Similarly, a part of the cables 505 may be bonded to the receiving member 760 with an aluminum tape or adhesive.

Figure 9:
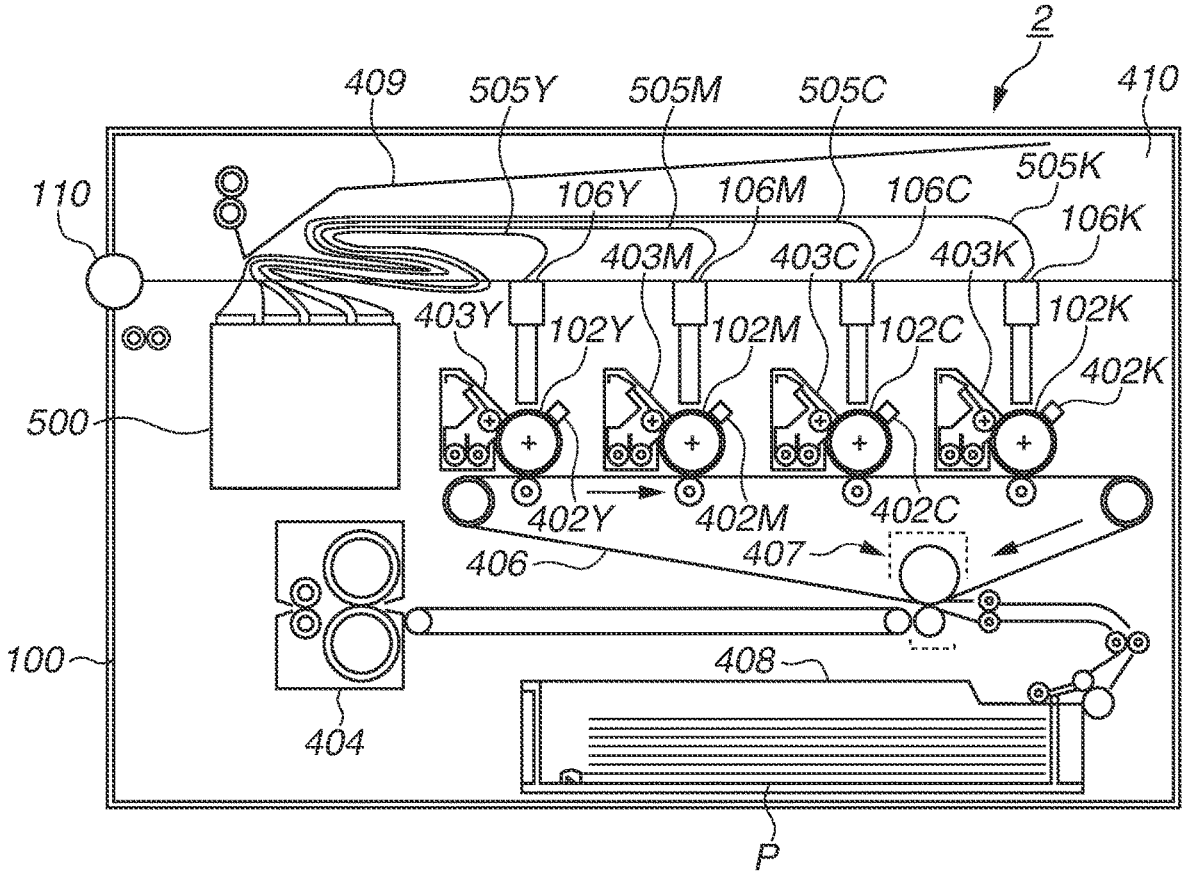
FIG. 9 is a cross-sectional view schematically illustrating an image forming apparatus according to a comparative example in which cables pass through the front side of a rotating shaft.

Advantages produced by the cables 505 being routed on the back side of the rotating shaft 110 will be described below, in comparison with a cross-sectional view schematically illustrating an image forming apparatus 2 illustrated in FIG. 9. FIG. 9 is a cross-sectional view schematically illustrating the image forming apparatus 2 in which the cables 505 are routed on the front side of the rotating shaft 110. Referring to FIG. 9, members having substantially equivalent functions to those of members of the image forming apparatus 1 are assigned the same reference numerals, and duplicated descriptions thereof may be omitted.

As in the image forming apparatus 1, the image forming apparatus 2 illustrated in FIG. 9 also includes the cables 505Y to 505K for connecting the main unit substrate 500 and the optical print heads 106Y to 106K, respectively. In the image forming apparatus 2, unlike the image forming apparatus 1 of the present disclosure, the cables 505 are wired on the front side of the rotating shaft 110 on which the optical print heads 106 are disposed.

The distance between the optical print heads 106 and the main unit substrate 500 with the cover 410 opened with respect to the main body housing 100 is longer than the distance of the optical print heads 106 and the main unit substrate 500 with the cover 410 closed with respect to the main body housing 100. Considering that a state where the optical print heads 106 are connected to the main unit substrate 500 is maintained even with the cover 410 opened, the cables 505 are bent near the rotating shaft 110 with the cover 410 closed, as illustrated in FIG. 9.

In this case, the distance of the path ranging from the "optical print heads 106" to the "main unit substrate 500" via the "rotating shaft 110" remains unchanged regardless of whether the cover 410 is open or closed. More specifically, as in the image forming apparatus 1 of the present disclosure, the cables 505 are wired to pass through the side (portion closer to the back side of the image forming apparatus 1) of the rotating shaft 110 opposite to the other side where the optical print heads 106 are disposed, and the length of the cables 505 is adjusted to prevent bending as much as possible with the cover 410 closed. Thus, the amount of bending of the cables 505 as illustrated in the image forming apparatus 2 can be reduced not only when the cover 410 is closed but also when the cover 410 is open.

As illustrated in FIG. 9, with the cables 505 overlapping in a multiple way, a capacitance occurs between the leads of the different cables 505. The way the different cables 505 overlap with each other with the cover 410 closed changes each time the cover 410 is open or closed. Thus, the capacitance occurring between the leads of the different cables 505 also changes in various way. As a result, the control signals transmitted from the main unit substrate 500 to the optical print heads 106 are also affected, possibly causing inferior image forming. Naturally, even for each individual cable 505 bent and curved, a capacitance occurs between the leads at overlapping portions. As a result, even for each individual cable 505, the control signals passing through the cable 505 are affected by the capacitance. For this reason, the bending of the cables 505 with the cover 410 closed, as illustrated in FIG. 9, is to be prevented as much as possible. The configuration of the image forming apparatus 1 of the present disclosure is also a configuration intended to solve the above-described issue.

In the configuration of the image forming apparatus 2, the provision of spaces for storing the bent portions of the cables 505 inside the cover 410, the main body housing 100, or both is desirable. By contrast, in the image forming apparatus 1 of the present disclosure, it is not necessary to provide such spaces for storing the bent portions of the cables 505. Thus, it is only necessary to allocate a path for wiring the cables 505 behind the rotating shaft 110, making it possible to downsize the entire apparatus.

When the cables 505 are bent and curved during an open/close operation for the cover 410, the different cables 505 or different portions of the same cable 505 are rubbed, which produces friction, and static electricity may be charged. By routing the cables 505 on the back side of rotating shaft 110, the amount of bending of the cables 505 when the cover 410 is closed can be reduced. This configuration provides prospective advantageous effects of preventing the different cables 505 and different portions of the same cable 505 from being rubbed and the occurrence of friction, thus reducing the amount of static electricity charged on the cables 505.

Figure 7:
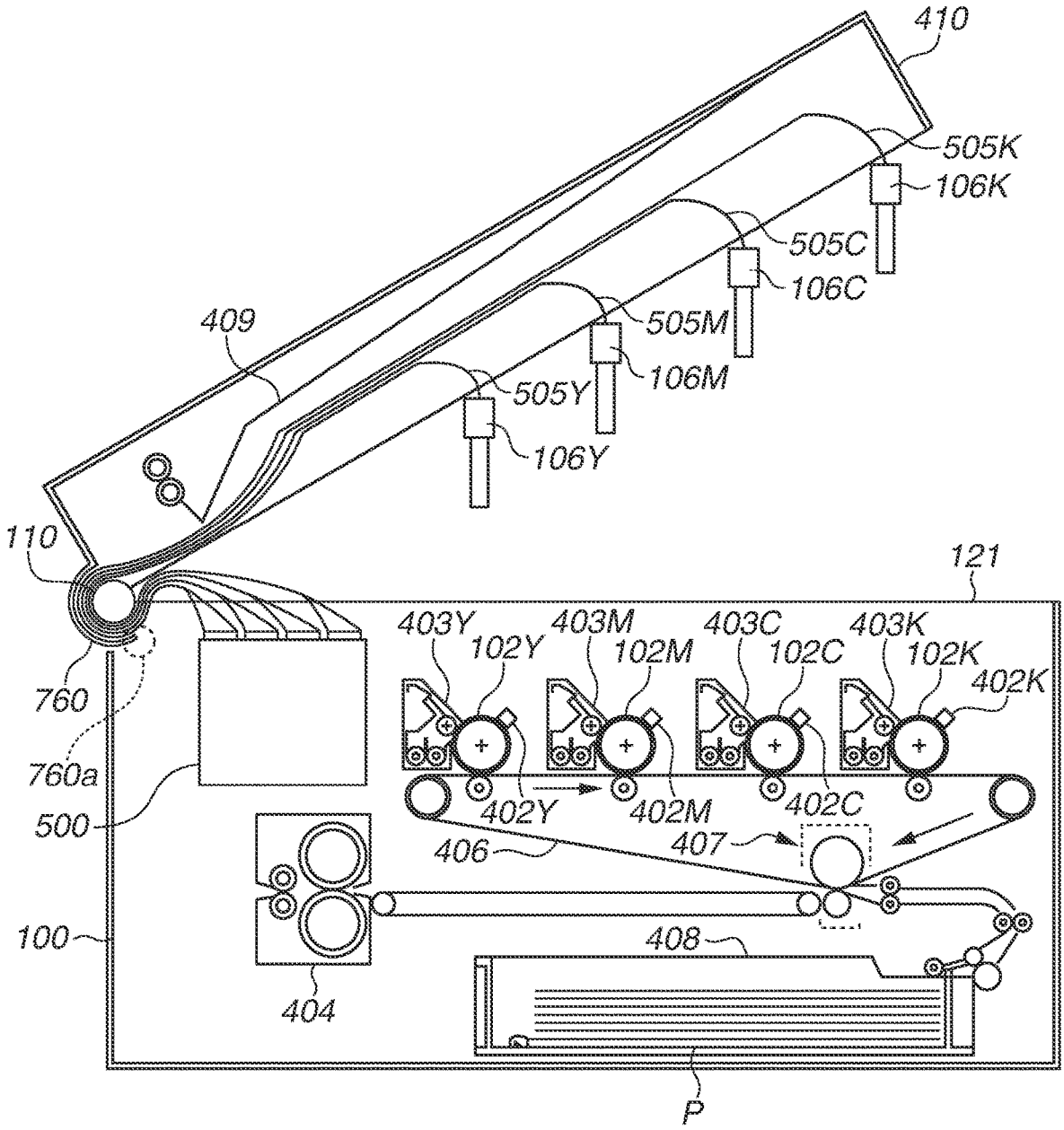
FIG. 7 illustrates an image forming apparatus having a receiving member on a cover.

FIG. 7 illustrates a configuration in which the receiving member 760 for the cables 505 routed on the back side of the rotating shaft 110 is disposed on the cover 410. As illustrated in FIG. 7, since the receiving member 760 is disposed on the cover 410, the position of a lower end portion 760*a* of the receiving member 760 with the cover 410 opened is higher in the vertical direction than the position of the lower end portion 760*a* of the receiving member 760 with the cover 410 closed. Thus, when the cover 410 is opened, the lower end portion 760*a* of the receiving member 760 supports the cables 505 routed around the rotating shaft 110 toward the direction opposite to the gravity direction. Therefore, in a case where the receiving member 760 is formed of a metallic member and grounding is ensured, forming the receiving member 760 on the cover 410 enables unfailingly discharging static electricity charged on the surface of the cables 505 through grounding when the cover 410 is opened.

As illustrated in FIG. 1 or 2, even without disposing the receiving member 760 in the main body housing 100, static electricity can be prevented from being charged on the surface of the cables 505 by disposing the receiving member 760 on the cover 410 and routing the cables 505 between the receiving member 760 and the rotating shaft 110, as illustrated in FIG. 7. In addition, the receiving member 760 may be formed of a metallic member and grounded, or the rotating shaft 110 may be formed of a metallic member and grounded. Naturally, both the receiving member 760 and the rotating shaft 110 may be formed of a metallic member and grounded. Since the cables 505 move in the gravity direction by their own weight, the cables 505 contact a portion on the vertically up side of the rotating shaft 110 and the lower end portion 760*a* of the receiving member 760. Therefore, with the cover 410 closed, the surface of the cables 505 is unfailingly grounded.

Figure 8:
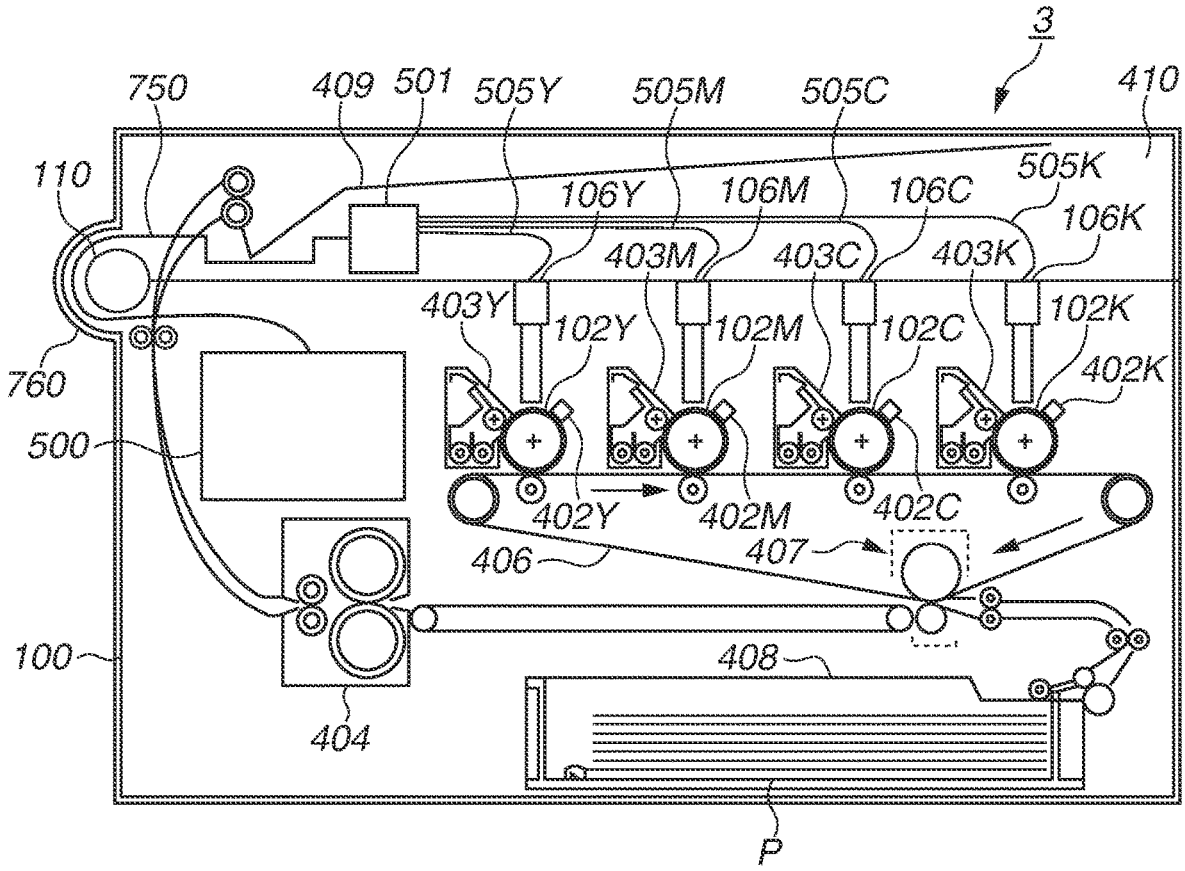
FIG. 8 illustrates an image forming apparatus having a relay substrate in a cover.

FIG. 8 illustrates an image forming apparatus 3 in which the relay substrate 501 is disposed on the cover 410. In FIG. 8, members having substantially equivalent functions to those of members of the image forming apparatus 1 are assigned the same reference numerals, and duplicated descriptions thereof may be omitted. Unlike the image forming apparatus 1 illustrated in FIGS. 1 and 2, the main unit substrate 500 transmits control signals to the optical print heads 106 via the relay substrate 501.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2018-217568, filed Nov. 20, 2018, which is hereby incorporated by reference herein in its entirety.

What is claimed is:

1. An image forming apparatus comprising:

a housing;

a drum unit having a photosensitive drum, configured to be attachable to and detachable from the housing through an opening on the housing;

a cover configured to rotate with respect to the housing with a grounded metallic shaft member as a rotational axis, and to be movable to a closed position where the opening is closed and to an open position where the opening is open;

a print head disposed on the cover and having a light emitting element for emitting light to expose the photosensitive drum;

a control substrate disposed on the housing, configured to generate a control signal for controlling driving of the light emitting element; and a cable connected to the print head and the control substrate to transmit the control signal from the control substrate to the print head, wherein the cable is connected to the print head and the control substrate by passing on one side of the shaft member, the one side being opposite to a side on which the print head is disposed, in such a manner that the cable contacts the shaft member when the cover is at the closed position.

2. The image forming apparatus according to claim 1, wherein the cable is connected to the print head and the control substrate by passing vertically above the shaft member, and wherein the shaft member supports the cable in the direction opposite to the gravity direction.

3. The image forming apparatus according to claim 1, wherein the shaft member is provided with a metallic stopping member having an opening as a passage for the cable, and wherein the cable is in contact with the stopping member and is grounded.

4. The image forming apparatus according to claim 1, wherein the cable is a flexible flat cable.

5. The image forming apparatus according to claim 1, wherein the rotational axis of the cover is parallel to a longitudinal direction of the print head.

6. The image forming apparatus according to claim 1, wherein the drum unit is detached vertically upwardly through the opening on the housing.

7. An image forming apparatus comprising:

a housing;

a drum unit having a photosensitive drum, configured to be attachable to and detachable from the housing through an opening on the housing;

a cover configured to rotate with respect to the housing with a grounded metallic shaft member as a rotational axis, and to be movable to a closed position where the opening is closed and to an open position where the opening is open;

a plurality of print heads disposed on the cover and each having a light emitting element for emitting light to expose the photosensitive drum;

a first substrate disposed on the cover and electrically connected to each of the plurality of print heads;

a second substrate disposed on the housing, configured to generate a control signal for controlling driving of the light emitting elements; and a cable connected to the first and the second substrates to transmit the control signal from the first substrate to the plurality of print heads, wherein the cable is connected to the first and the second substrates by passing on one side of the shaft member, the one side being opposite to a side on which the plurality of print heads is disposed, in such a manner that the cable contacts the shaft member when the cover is at the closed position.

8. The image forming apparatus according to claim 7, wherein the cable is connected to the first and the second substrates by passing vertically above the shaft member, and wherein the shaft member supports the cable in the direction opposite to the gravity direction.

9. The image forming apparatus according to claim 7, wherein the shaft member is provided with a metallic stopping member having an opening as a passage for the cable, and wherein the cable is in contact with the stopping member and is grounded.

10. The image forming apparatus according to claim 7, wherein the plurality of print heads is arranged in a row along a direction perpendicular to a rotation center axis of the cover.

11. The image forming apparatus according to claim 7, wherein the cable is a flexible flat cable.

12. The image forming apparatus according to claim 7, wherein the rotational axis of the cover is parallel to a longitudinal direction of each of the plurality of print heads.

13. The image forming apparatus according to claim 7, wherein the drum unit is detached vertically upwardly through the opening on the housing.

* * * * *